US005611660A

United States Patent [19]

Wong et al.

[11] Patent Number: 5,611,660

[45] Date of Patent: Mar. 18, 1997

[54] COMPOUND VACUUM PUMPS

[75] Inventors: David C. Wong, Wisborough Green; Nigel P. Schofield, Horsham, both of England

[73] Assignee: The BOC Group plc, Windlesham Surrey, England

[21] Appl. No.: 538,999

[22] Filed: Oct. 5, 1995

Related U.S. Application Data

[63] Continuation of Ser. No. 302,561, Sep. 8, 1994, abandoned.

[30] Foreign Application Priority Data

Sep. 10, 1993 [GB] United Kingdom ..... 9318801

[51] Int. Cl.[6] ..... F04D 19/04

[52] U.S. Cl. ..... 415/90

[58] Field of Search ..... 415/90, 143, 198.1, 415/199.5; 417/423.4

[56] References Cited

U.S. PATENT DOCUMENTS

| | | | |
|---|---|---|---|
| 3,628,894 | 12/1971 | Ferguson et al. . | |
| 4,732,529 | 3/1988 | Narita et al. . | |
| 5,074,747 | 12/1991 | Ikegami et al. | 415/90 |
| 5,238,362 | 8/1993 | Casaro et al. | 415/90 |
| 5,358,373 | 10/1994 | Hablanian | 415/90 |

FOREIGN PATENT DOCUMENTS

| | | | |
|---|---|---|---|
| 0226039 | 6/1987 | European Pat. Off. . | |
| 0445855 | 9/1991 | European Pat. Off. . | |
| 239213 | 1/1909 | Germany . | |
| 3919529 | 1/1990 | Germany . | |
| 336001 | 10/1930 | United Kingdom . | |
| 94/25760 | 11/1994 | WIPO | 415/199.5 |

*Primary Examiner*—James Larson

*Attorney, Agent, or Firm*—David M. Rosenblum; Larry R. Cassett

[57] ABSTRACT

A hybrid vacuum pump comprising a turbomolecular stage positioned at the inlet end of the pump and comprising a stator formed from an array of stationary blades and a rotor formed from a further array of blades arranged for rotation at high speed between the stator blades. A molecular drag stage is positioned at the outlet (high pressure) end of the pump and comprises at least two discs arranged for rotation within a stator with a minimal clearance between the circumferential edge of the discs and the stator. A flow passageway linking the turbomolecular stage with annular channels is defined between the stator and opposing faces of the discs and projections extending from the stator are provided for deflecting gas being pumped from the annular channels during rotation of the discs.

4 Claims, 1 Drawing Sheet

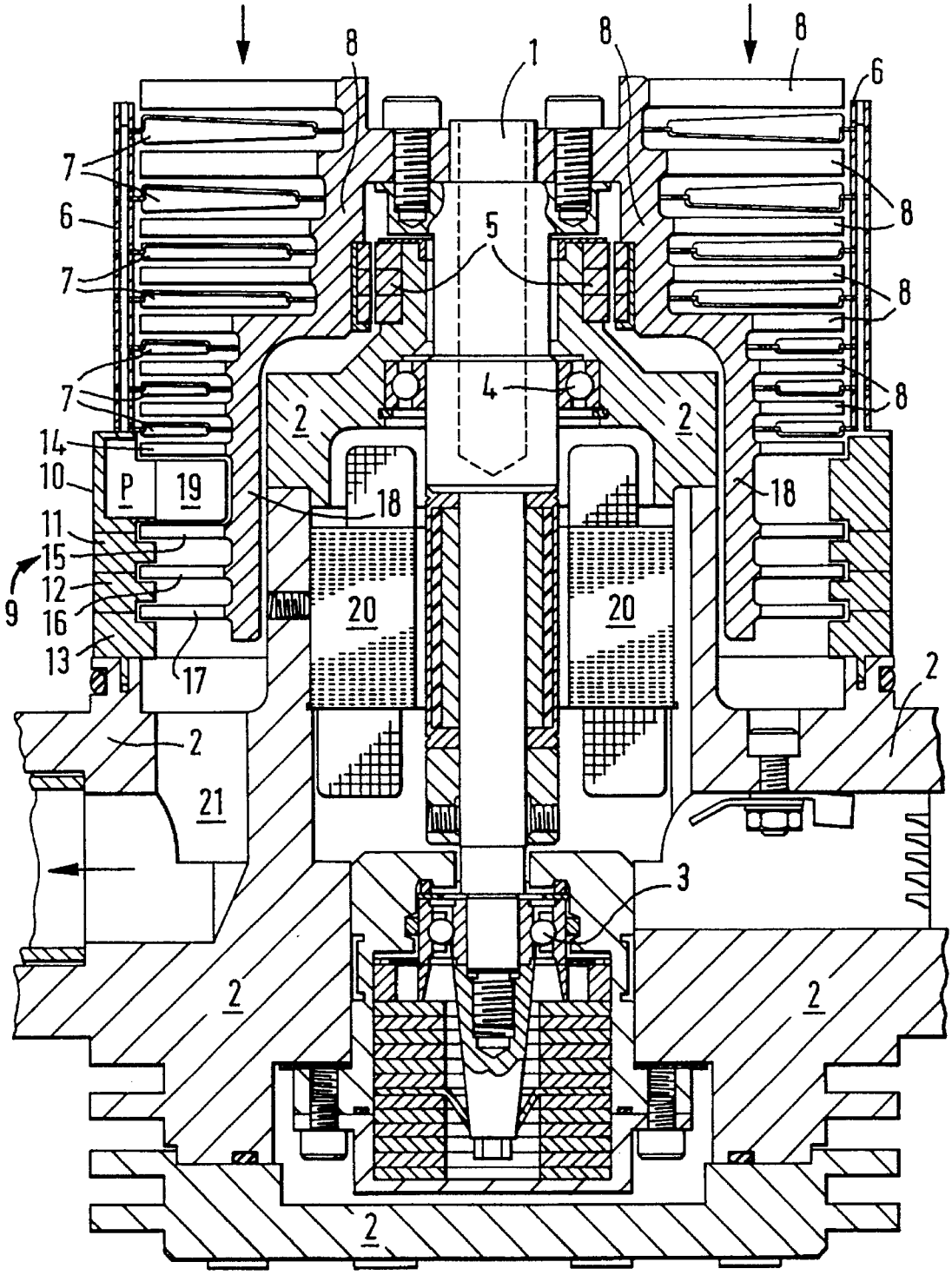
1
2
3
4
5
6
7
8
9
10
11
12
13
14
15
16
17
18
19
20
21
P

COMPOUND VACUUM PUMPS

This is a continuation of application Ser. No. 08/302,561 filed Sep. 8, 1994, abandoned.

BACKGROUND OF INVENTION

This invention relates to improvements in those types of vacuum pump known as turbomolecular pumps, and more particularly relates to a "hybrid" or compound pump having a turbomolecular stage and a stage of different operational mode for improving the operating range of pressures and throughput.

A standard turbomolecular pump includes a rotor comprising arrays of (normally) angled blades arranged for rotation at high speed, for example up to sixty thousand revolutions per minute, between alternately arranged arrays of stationary blades of a stator; generally the blades of the stator are inclined in the opposite direction to those of the rotor. In such pumps, gas is received from a high vacuum chamber, compressed and delivered to a backing pump inlet, normally that of a two stage rotary pump. The backing pump is required in that the turbomolecular pump normally operates with exhaust pressure up to about $10^{-1}$ mbar and the use of the backing pump can provide backing pressures in this region and deliver pumped gas to the atmosphere.

Compound pumps are known in which the turbomolecular stage and a further stage are present in a single pump. The further stage may, for example, be a screw rotor stage or a spiral groove stage or certain types of other molecular drag stage. Nevertheless, there remains a need for improved hybrid pumps.

The present invention is concerned with the provision of a hybrid pump in which the further stage, i.e. in addition to the turbomolecular stage, has been found to be particularly useful in conjunction with the turbomolecular stage itself.

SUMMARY OF INVENTION

In accordance with the invention, there is provided a hybrid vacuum pump comprising:

- a turbomolecular stage positioned at the inlet end of the pump and comprising a stator formed from an array of stationary blades and a rotor formed from a further array of blades arranged for rotation at high speed between the stator blades, and
- a molecular drag stage positioned at the outlet (high pressure) end of the pump and comprising at least two discs arranged for rotation within a stator with a minimal clearance between the circumferential edge of the discs and the stator, a flow passageway linking the turbomolecular stage with annular channels defined between the stator and opposing faces of the discs, and means for deflecting gas being pumped from the annular channels during rotation of the discs.

Preferably the molecular drag stage comprises more than two discs, for example three, four or five, such that an annular channel is defined between any two discs. The flow passageway can then usefully be arranged to link the molecular drag stage inlet with each of the annular channels in turn and with a molecular drag stage outlet in to which gas can be exhausted. Generally there will be gas deflecting means associated with each annular channel. Preferably, there is a minimal clearance between the stator and the circumferential edge of each disc of the second stage.

The gas deflecting means is preferably a projection, for example one extending from the stator, which extends in to the annular channel and which substantially blocks the channel at the point at which it extends. This projection is usefully associated with an inlet to and an outlet from the annular channel for the purposes described below.

In the preferred case in which a plurality of discs are present, it is advantageous for the projections for the different annular channels to be spaced around the periphery of the stator so that the inlets to and outlets from each channel can be more readily accommodated in, for example, the stator body.

In preferred embodiments, the stator itself partially projects in to some or (preferably) all of the annular channel. In such embodiments, it is useful for that part of the stator within the channel to have as little a clearance as possible with the disc. This partial projection of the stator in to the channel, especially with a minimal clearance between the stator and the disc, has been found to aid "sealing" of the molecular drag stage generally and thereby to aid pumping efficiency overall.

In further preferred embodiments, it has been discovered that the use of stator ring components for the molecular drag stage which can be aligned and assembled to provide the total stator structure can be advantageous.

Such further preferred embodiments can be particularly beneficial (and generally essential in embodiments in which the deflecting means is integrally formed with the stator) in the case of a multiple disc molecular drag stage having a partially projecting stator as described above. In particular, the use of a "split" stator ring component for that part of the stator adjacent each disc allows for the stator to be efficiently built (and dismantled) about each disc. Most preferred split stators are semi-circular in shape.

It may be expedient for reasons of power economy or otherwise for the diameter of the discs in the molecular drag stage to decrease in a direction towards the molecular stage outlet. This is preferably, although not necessarily, effected by uniform decreases in disc diameter from the disc nearest the molecular drag stage inlet to the disc nearest the molecular drag stage outlet.

An important feature of the invention is that it has been found that it is particularly useful for use in conjunction with a hybrid turbomolecular pump employing magnetic bearings rather than more conventional bearings such as ball bearings. This is because the construction of the second stage allows for good sealing, especially when using the preferred embodiments in which the stator partially projects in to the channel(s) adjacent the disc(s). The "horizontal" sealing area between the stator and disc allowed in such embodiments is important in allowing a certain extra degree of lateral (as opposed to axial) movement of the discs within the stator.

A further feature of the invention is the possibility of including an inlet pumping port between the turbomolecular and molecular drag stages. Such an "interstage" port could allow entry into the pump of the invention directly into a (commonly the first) annular channel of the molecular drag stage of the pump, thereby utilizing only the molecular drag stage when appropriate or using both ports simultaneously for pumping a vacuum system.

BRIEF DESCRIPTION OF THE DRAWING

For a better understanding of the invention, reference will now be made, by way of exemplification only, to the accompanying drawing which shows a sectional view (partially schematic) through a hybrid vacuum pump of the invention.

DETAILED DESCRIPTION

With reference to the drawing, there is shown therein a hybrid vacuum pump comprising a central shaft 1 mounted for rotation within a multicomponent stator body generally shown as 2 and supported therein by means primarily of a deep groove ball bearing race 3, a back up ball bearing race 4 and magnetic bearings 5.

The pump comprises two basic stages; firstly there is a turbomolecular stage comprising a cylindrical stator wall 6 attached to the stator body 2 and from which extend radially a plurality of stator vanes 7 which collectively define seven annular arrays of vanes, each annular array having about twenty such vanes. The turbomolecular stage also comprises a plurality of rotor vanes attached to the rotor body 8 which again define seven annular arrays of vanes, each array having about twenty such vanes. The vanes of the respective stator body and rotor body are angled relative to each other in a manner known per se in turbomolecular vacuum pump technology.

The second basic stage of the pump is the molecular drag stage comprising a stator portion 9 which links the stator body 2 and the stator wall 6; stator portion 9 itself comprises four separate ring shaped sections 10, 11, 12, 13 interlocked together to form a generally cylindrical portion 9 overall. The molecular drag stage also comprises a series of four annular discs, 14, 15, 16, 17 mounted on the downwardly extending part 18 of the rotor body 8; rotor body 8 is generally of circular cross section overall.

The opposed faces of each of the discs 14, 15, 16 and 17, together with the internal surface of the stator portion 9 define an annular channel between each disc. It can be seen in the embodiment shown in the drawing that each of the individual sections 10, 11, 12, 13 of the stator portion 9 partially projects in to the respective annular channels. Although not essential, this partial projection of the stator is of benefit for reasons described below.

In addition, the stator possesses gas deflecting means for each annular channel in the form of a projection extending from the stator in a radial direction and substantially blocking the channel such that there is a minimal clearance between the stator projections and the respective disc faces.

The projection 19 is shown extending from the stator section 10 in to the annular channel formed between the discs 14 and 15. The projection is constructed integrally with the section 10, is substantially rectangular in shape, is about 15 mm thick and has a curved face to conform to the convex outer surface of the corresponding part of the rotor part 18.

The projections associated with the stator sections 11, 12, 13 are not shown in the drawing as they are positioned at different points around the inner circumference of their respective stator section. This enables the flow passageway through the molecular drag stage and in particular between each annular channel between the discs 14, 15, 16 and 17 to be more effectively positioned in terms of the ports between each channel (situated in the stator sections 10, 11, 12, 13) being spaced from each other.

The pump can be operated at the usual high speeds employed for turbomolecular pumps, for example up to sixty thousand revolutions per minute, by means of the motor generally shown at 20 positioned about the shaft 1.

In use of the pump, gas is drawn through the turbomolecular stage within the stator wall 6 in the direction shown by the arrows to the stage outlet beyond the seventh annular array of stator vanes, thence via a port P in the stator section 10 into the first molecular drag annular channel on the "downstream" side of the projection 19, thence via a further port in the stator section 10 and 11 at the "upstream" side of the projection 19 in to the second annular channel between the discs 15 and 16 (with the relevant projection (not shown) being positioned between the second channel inlet and outlet ports) and finally in to the third annular channel between the discs 16 and 17. Exhaust gas finally passes in to the pump outlet 21.

We claim:

1. A hybrid vacuum pump comprising;

an inlet end;

an outlet end;

a turbomolecular stage positioned at said inlet end and comprising a bladed stator formed from an array of stationary blades and a rotor formed from a further array of blades arranged for rotation at high speed between the stator blades; and a molecular drag stage positioned at the outlet end and comprising at least three discs arranged for rotation within a channeled stator, with a minimal clearance between circumferential edges of the discs and the channeled stator, a flow passageway linking the turbomolecular stage with annular channels, said annular channels defined between the channeled stator and opposing faces of the at least three discs and each of said annular channels defined between each of said discs said channeled stator projecting into said annular channels to effect seals between said at least three discs, and means for deflecting gas being pumped from the annular channels during rotation of the discs.

2. The vacuum pump according to claim 1 in which there is a minimal clearance between the channeled stator and each of the circumferential edges of each of said discs of the molecular drag stage.

3. The vacuum pump according to claim 1 in which the gas deflecting means of the molecular drag stage comprises projections extending into the annular channels and substantially blocking each of the annular channels at the point at which it extends.

4. The vacuum pump according to claim 3 in which the projections are peripherally spaced around the channeled stator.

* * * * *